US005350887A

United States Patent [19]

Sandström

[11] Patent Number: 5,350,887

[45] Date of Patent: Sep. 27, 1994

[54] METHOD AND APPARATUS FOR THE GENERATION OF LOW FREQUENCY SOUND

[75] Inventor: Roland Sandström, Saltsjö-Boo, Sweden

[73] Assignee: Infrasonik AB, Nacka, Sweden

[21] Appl. No.: 940,865

[22] PCT Filed: May 16, 1991

[86] PCT No.: PCT/SE91/00352

§ 371 Date: Oct. 27, 1992

§ 102(e) Date: Oct. 27, 1992

[87] PCT Pub. No.: WO91/17841

PCT Pub. Date: Nov. 28, 1991

[30] Foreign Application Priority Data

May 16, 1990 [SE] Sweden ..... 9001768

[51] Int. Cl.[5] ..... G10K 5/00

[52] U.S. Cl. ..... 181/142; 181/175; 116/137 R; 116/140; 331/155

[58] Field of Search ..... 181/119, 120, 142, 175, 181/182, 187, 189, 190; 116/137 R, 140; 331/155

[56] References Cited

U.S. PATENT DOCUMENTS

| | | | |
|---|---|---|---|
| 3,614,961 | 10/1971 | Nekrasov et al. | 137/81.5 |
| 3,814,050 | 6/1974 | Warnod | 116/140 |
| 4,359,962 | 11/1982 | Olsson et al. | 116/137 R |
| 4,574,632 | 3/1986 | Woolley et al. | 73/571 |
| 5,109,948 | 5/1992 | Sandstrom | 181/142 |

OTHER PUBLICATIONS

Swedish published application No. 8600588 dated Jun. 21, 1987.

International Publication No. WO 90/00095, dated Jan. 11, 1990, to Roland Sandström.

International Publication No. WO 80/01358, dated Jul. 10, 1980, to Mats Olsson.

*Primary Examiner*—J. Woodrow Eldred

*Attorney, Agent, or Firm*—Watson, Cole, Grindle & Watson

[57] ABSTRACT

The invention relates to a method and apparatus for the generation of low frequency sound by means of the excitation of a low frequency standing gas borne sound wave. A low frequency sound generator comprises a resonator part and a feeder part with a feeder unit. The method consists of a controlled generation of periodic changes of the gas volume of the resonator part in order to create a standing sound wave. The invention also includes a feeder unit for the working of the method. The feeder unit comprised of three rotating parts, namely one center rotor and two side rotors, the rotation of which are synchronized. The feeder unit is open on two sides, each side communicating with one tubular resonator. The rotors are provided with cut out portions and the center rotor is also provided with a protruding vane-shaped part. It is the rotation of the rotors in combination with their special shapes that generate periodic changes of the gas volume in the resonators without any internal compression in the feeder unit.

8 Claims, 3 Drawing Sheets

FIG. 3f
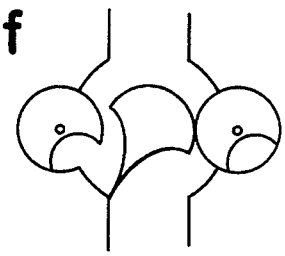
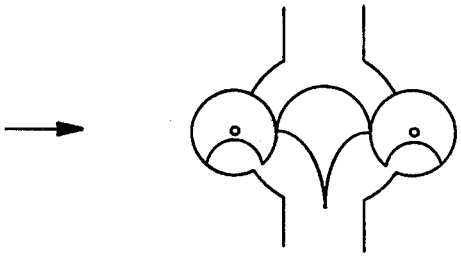
FIG. 3g
FIG. 3e
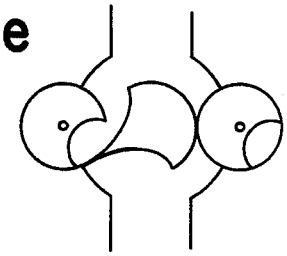
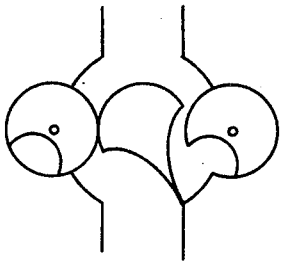
FIG. 3h
FIG. 3d
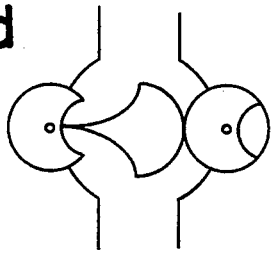
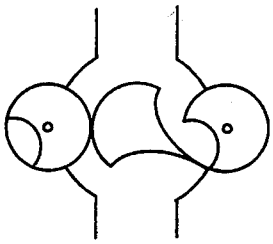
FIG. 3i
FIG. 3c
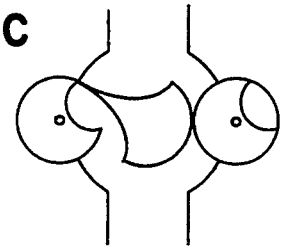
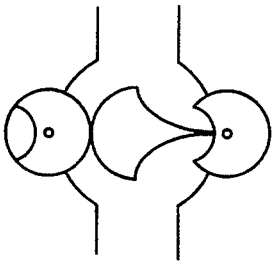
FIG. 3j
FIG. 3b
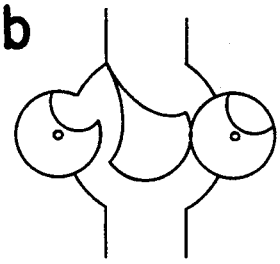
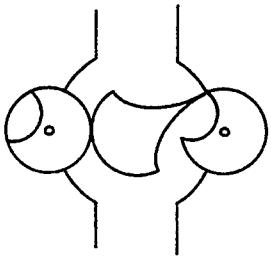
FIG. 3k
FIG. 3a
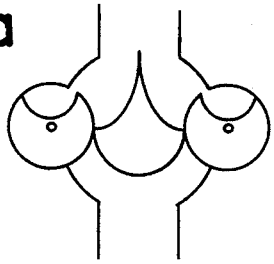
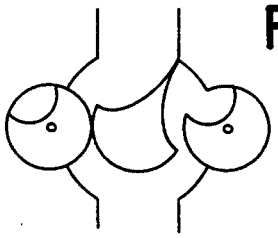
FIG. 3l

METHOD AND APPARATUS FOR THE GENERATION OF LOW FREQUENCY SOUND

BACKGROUND AND SUMMARY OF THE INVENTION

The invention relates to a method and an apparatus for the generation of low frequency sound. In particular the apparatus according to the invention relates to a feeder unit, also called exigator or pulsator, to be used with a low frequency sound generator. In addition to the feeder unit a low frequency sound generator includes some type of resonator, and the purpose of the feeder unit is to excite a low frequency standing, gas bourne, soundwave inside the resonator. By low frequency sound is, for the purpose of this context, understood sound of a frequency of less than 60 Hz and even infrasound of less than 20 Hz.

The low frequency sound generators are typically used to excite a standing gas-bourne sound wave and it is the resulting oscillating movement of the gas which may be utilized for industrial purposes. Various types of low frequency sound generators for industrial use are previously known, for example through EP, B1, 0 006 833 and WO 88/07894. However, for some applications of low frequency sound, for example as described in WO 90/05275, it is desirable to use more than one low frequency sound generator. The operation of these low frequency sound generators must then be coordinated and synchronized in order to get maximum effect. As described in the mentioned WO 90/05275 this may be achieved by means of letting two motor driven feeder units be driven by a common motor. However, the apparatus according to the invention herein described offers a simpler solution to the problem of synchronization. Instead of using two feeder units, the apparatus herein described provides the possibility of employing only one feeder unit and this feeder unit is capable of servicing two resonators.

The present feeder unit has been designed in such a way that it may also be used to service only one resonator.

The basic principle for the method and the operation and design of the feeder unit (or pulsator) according to the invention is to generate periodic changes of the volume of a resonator and by having the period of the volume changes correspond to the natural frequency of the resonator a standing sound wave is excited in the resonator. The feeder unit comprises of three rotating parts, rotors, of basically cylindrical shapes and which are mounted in a casing. The rotors are driven by a common motor and their rotation is subsequently automatically synchronized. On two sides of the rotor complex a resonator is mounted. The rotation of the rotors in combination with their very special shape, together result in that a small volume of air or other gas is being transported from one resonator to the other resonator and then back to the first resonator. This back and forth transport of air is a continuous process in that as long as the rotors are rotating air is being transported from either of the resonators to the other resonator. By feeding a volume of air into either resonator and then by means of the movement of the rotors first decrease the volume of the resonator and then increase said volume and repeating this sequence with a certain periodicity, a standing, gas bourne, sound wave of a certain low frequency is excited inside the resonator corresponding to the first natural frequency of the resonator, which is determined by its dimensions. This is achieved by having the rotation frequency of the rotors, which is determined by the motor, correspond to the natural frequency of the resonator.

BRIEF DESCRIPTION OF THE DRAWINGS

The invention shall now be described in more detail with reference made to the accompanying drawings illustrating embodiments:

FIG. 3*a*–3*l* are a sequence of schematic drawings representing the different stages in the operation cycle of the feeder unit.

DETAILED DESCRIPTION OF THE PREFERRED EMBODIMENTS

Figure 1:
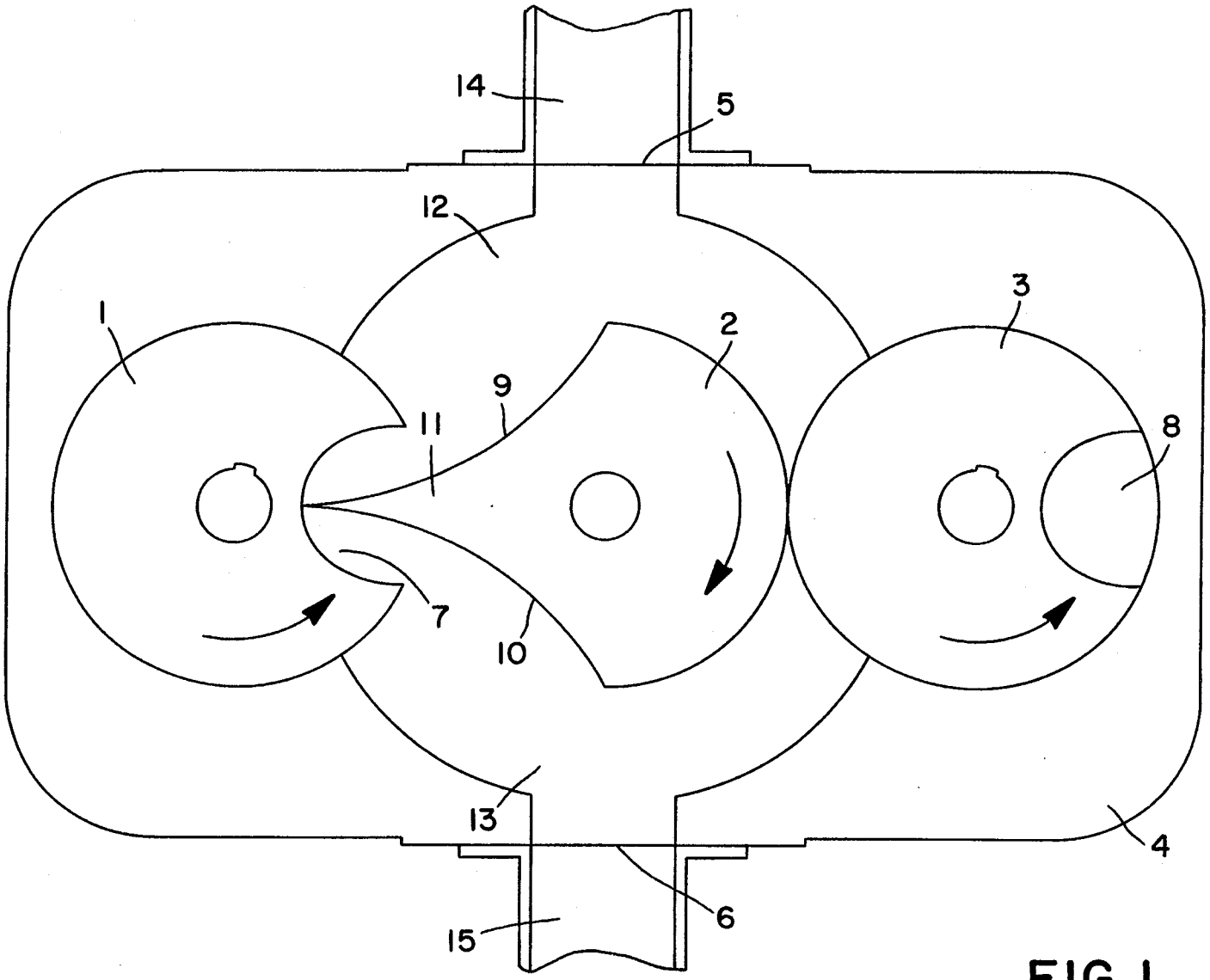
FIG. 1 shows a sectional top view of one embodiment of the feeder unit.

The apparatus according to the invention, as illustrated in the embodiment of FIG. 1, comprises of three rotating bodies 1, 2, 3 hereinafter referred to as left side rotor 1, centre rotor 2 and right side rotor 3, mounted in a casing 4. The shape of all three rotors is basically a circular cylinder, all three having the same radius and they are all provided with one or several axial, longitudinal and cylindrical cut out portions 7, 8, 9, 10 on the envelope surface, stretching along the entire axial length of the cylinder. The two side rotors are of identical shape with one cut out portion 7, 8 of cylindrical shape. The centre rotor differs in its shape from the side rotors. The centre rotor is provided with two cut out portions 9, 10 and between the cut out portions a blade or vane-shaped part 11 is protruding beyond the circumference of the basic cylinder shape of the centre rotor. The blade may be made in one piece with the rotor. All three rotors are mounted by means of bearings in the casing 4. Their rotation is synchronized and they are all being driven by the same motor. The centre rotor rotates in one direction while the side rotors rotates in the opposite direction. This may be achieved through having direct drive of the centre rotor by the motor while the side rotors are being driven by the same motor using the intermediary of a cog wheel or similar arrangement.

The shape of the inside of the casing 4 is determined by the shape of the rotors. The inside of the casing circumscribes the major part of each side rotor's 1,3 circumference and the side rotors are made to seal against the inside of the casing leaving just enough clearance for the side rotors to rotate freely. The centre rotor 2 is situated between the side rotors and in the centre of the casing. Due to the blade 11 of the centre rotor protruding beyond the circumference of the centre rotor and since the centre rotor and its blade must be able to rotate in the casing with just a fine clearance, this means that there is a circular space in the centre of the casing whose radius is determined by the the length of the blade of the centre rotor measured from the axis of the centre rotor. This has the result that a chamber 12, 13 is created on each side of the centre rotor which is limited by the wall of the casing and the rotors. When rotating, the blade of the centre rotor will seal against the inside of the casing or the inner surface of the cut out portions in the side rotors. The envelope surface of the centre rotor will at certain stages of the operation cycle seal against the envelope surface of either side rotor. However, whenever any part of the centre rotor seals against a surface there is always enough clearance to allow the rotors to rotate freely. There are also openings 5, 6 in the casing for the connection of resonators 14, 15. Thereby the chambers 12, 13 are in constant communication with the resonator on the corresponding side of the feeder and the air volume in the chambers is in contact with the air volume in the respective resonator. Consequently the feeder is always open on its two sides towards the resonators.

Figure 2:
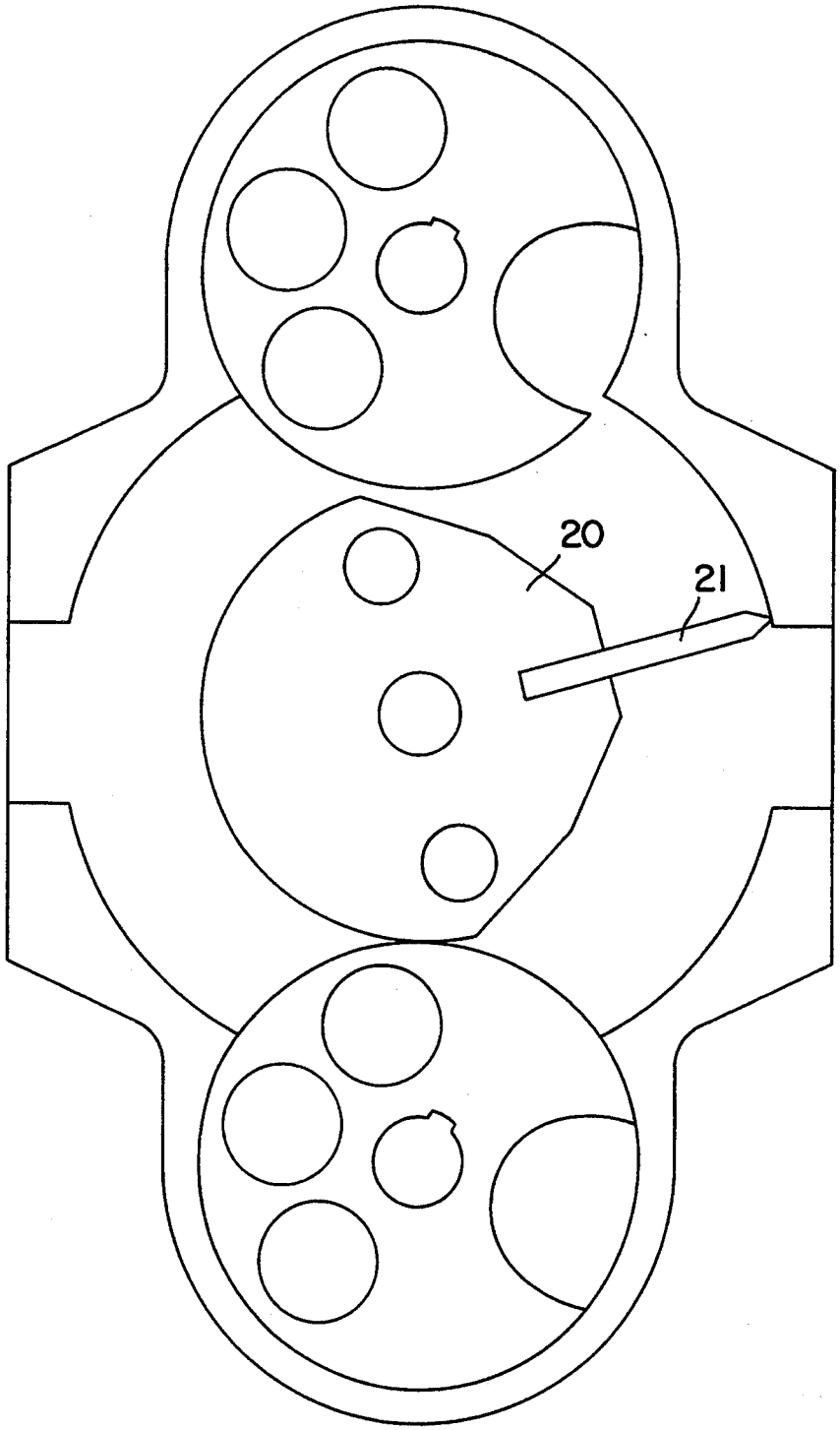
FIG. 2 illustrates a modified embodiment of the feeder unit.

The embodiment illustrated in FIG. 2 shows an apparatus where the centre rotor 20 differs from the centre rotor of the embodiment in FIG. 1. The cut out portions are here in the shape of three circular segments cut off from the rotor. The blade 21 of the rotor is not made in one piece with the rotor but is a separate part mounted in or on the rotor. The blade is situated in the centre of one of the cut out portions while the two other cut out portions which are identical are located on both sides of the cut out portion where the blade is mounted. In this embodiment is also shown how holes may be made in the rotors in order to decrease their weight and also to improve their rotating balance which is affected by the cut out portions.

The apparatus functions as described in the following text where reference is being made to the sequence of schematic FIGS. 3*a*–3*l* and which represent different stages in the operation cycle of the feeder unit according to the invention. The drawings show a feeder unit with two resonators, one on each side. The two side rotors rotates in a direction which is clockwise while the rotation of the centre rotor is counterclockwise and they all rotate with the same constant speed determined by the common motor. Starting with FIG. 3*a* at the bottom on the left side and going upwards, FIG. 3*a* shows a neutral position where the sound pressure on both sides of the rotors is zero. In this position the contact surfaces, i.e. the envelope surface, of all three rotors are "in contact" with each other. By the expression "in contact" is for the purposes of this context referring to FIGS. 3*a*–3*l*, not meant actual, physical contact. Instead, since there should be a clearance between the rotors in this position which should be only enough to allow free motion of the rotors and it is understood that in practice the contact surfaces shall seal against each other so that no air or gas should be able to flow from one of the resonators to the other resonator, the word "in contact" and also "seal" should be understood to mean the above described condition. In this position the vane or blade of the centre rotor is pointed along the centre line of the opening of one of the resonators, for the purpose of these figures referred to as the upper resonator. In FIG. 3*b* the rotors have rotated to a position where the blade of the centre rotor has just entered into contact with the casing of the feeder unit and as can be seen there is already an opening created between the left side rotor and the centre rotor. This shows that no internal compression takes place inside the feeder unit. Instead the air volume between the left rotor, the casing and the centre rotor is in contact with the air volume in the lower resonator. It is this total resulting air volume enclosed between the rotors and inside the resonator which is subject to the volume changes caused by the movement of the rotors, primarily the blade of the centre rotor, as shown in FIGS. 3*c*, 3*d* and 3*e*. At the same time the air volume of the upper resonator including the air volume in the upper part of the feeder unit expands thus resulting in lower air pressure on the upper side of the rotors.

In the following FIG. 3*f* the blade is just about to cease its contact with the casing and there is still a small opening between the centre rotor and the left side rotor. In accordance with FIG. 3*b*, no internal compression will have taken place at the moment when the blade leaves the casing and thereby lets the air volume between the mentioned rotors and the casing come into contact with the air volume in the lower resonator thus resulting in one air volume.

In an analogue way FIGS. 3*g*–3*l* show how the air volume in the resonator on the lower side of the rotors is compressed while the air volume on the upper resonator side of the rotors is expanded. FIG. 3*a* shows the second neutral position of the apparatus.

By repeating the cycle described in FIGS. 3*a*–3*l* periodic volume changes are generated in the entire mass of the resulting air volume on either side of the rotors and when these volume changes are controlled, by means of controlling the rotation speed of the rotors, to have a period corresponding to the natural frequency of the resonator a standing sound wave is excited.

Another way of describing the operation of the feeder unit according to the invention is that the synchronized rotation of the rotors achieve that a movement of a certain volume of air or gas is performed from one resonator to the other resonator and that this movement is repeated in order to obtain a continuous back and forth movement of that volume of air or gas. Or, while air or gas is being evacuated from one resonator, the corresponding volume of air or gas is simultaneously being fed to the other resonator and vice versa.

The most common type of resonator to be used would be a tubular resonator. A suitable length of the resonator would be a length corresponding to a quarter or half of the wavelength of the low frequency sound generated. When two tubular resonators are connected to the openings 5, 6 of the feeder unit the standing sound waves excited inside the resonators will be in counterphase with each other. If the two tubular resonators are of the quarter-wavelength type with one open end they may be connected at their open ends. By doing this one resonator of the half-wavelength type is created having the same natural frequency as the separate quarter-wavelength resonators, and a common standing sound wave will be the result. However, depending on the space available and the surroundings where the feeder and resonator are to be utilized, other types of resonators may be used.

The feeder unit according to the invention is not limited to use with two resonators but may also be used with only one resonator. This may be done by simply installing a cover over one of the openings or a small box of some kind.

In the description the resonators and feeder unit have described to contain air but naturally any other suitable gas may be used. It would also be obvious that the geometric shapes of the rotors and particularly the centre rotor are not restricted to what is shown in the enclosed figures but may be modified within the scope of the invention.

I claim:

1. Feeder unit for a low frequency sound generator, said low frequency sound generator comprising a feeder part including said feeder unit and a resonator part for the excitation of a low frequency, standing, gas borne sound wave inside the resonator part, said feeder unit being provided with means for controlled generation of periodic changes of the gas volume inside the resonator part, said means comprising a plurality of rotating rotors located in a casing and wherein the rotation of said rotors in combination with their geometric designs work to achieve volume changes in the gas inside the resonator part.

2. Feeder unit as claimed in claim 1, wherein said volume changes are achieved by alternatively evacuating gas from and feeding gas to the resonator part.

3. Feeder unit as claimed in claim 2, comprising three rotors, namely one centre rotor, one left side rotor and one right side rotor, the rotation of the rotors being synchronized and the centre rotor rotating in a direction opposite the direction of rotation of the two side rotors.

4. Feeder unit as claimed in claim 3, wherein said means also comprises of a motor which drives said rotors in order for the rotation of the rotors to be synchronized and the rotation of the rotors is controlled by said motor to generate periodic volume changes in said gas volume of a frequency corresponding to the natural frequency of the resonator part, thus exciting said standing sound wave.

5. Feeder unit as claimed in claim 4, wherein the rotors are of a basically circular cylindrical shape, wherein the two side rotors each have one curved cut out portion in an envelope surface thereof, wherein the centre rotor has at least two cut out portions in a envelope surface thereof, and wherein the centre rotor is provided with a vane-shaped portion protruding beyond the circumference of the basic cylinder shape of the centre rotor.

6. Feeder unit as claimed in claim 5, wherein the shape of the cut out portions of the side rotors is such that the vane-shaped portion of the centre rotor, when the rotors are rotating, closely follows the inside of the curved cut out portions of the side rotors as well as the inside of the casing with a fine clearance which does not allow the passage of any air or gas, and wherein rotors have envelope surfaces which follows the inside of the casing and each other with a fine clearance not allowing any passage of air or gas.

7. Feeder unit as claimed in claim 2, wherein said resonator part comprises of two resonators, wherein said casing has two openings where the resonators are connected, wherein on either side of the rotors a chamber is formed limited by the inner wall of the casing and the rotors, wherein said chamber is in constant communication with the interior of the respective resonator so that the feeder unit is constantly open on two sides, and wherein it is the combined gas volume of the chamber and the resonator on the respective sides of the rotors which is subject to the periodic changes of the gas volume.

8. Feeder unit as claimed in claim 6, wherein when the rotors are rotating and the vane-portion of the centre rotor is nearing one of the openings there is always a gap allowing the passage of air or gas between the centre rotor and the side rotor which is closest to the vane-portion, said gap not being closed until after the vane-portion has reached the opening, with the result that there is no internal compression.

* * * * *